US011065658B2

(12) United States Patent
Matsubara et al.

(10) Patent No.: US 11,065,658 B2
(45) Date of Patent: Jul. 20, 2021

(54) NOTCHING EQUIPMENT FOR STEEL STRIP, METHOD OF NOTCHING STEEL STRIP, COLD ROLLING FACILITY, AND METHOD OF COLD ROLLING

(71) Applicant: JFE STEEL CORPORATION, Tokyo (JP)

(72) Inventors: Yukihiro Matsubara, Tokyo (JP); Yuu Nagai, Tokyo (JP); Kazuhisa Iwanaga, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 304 days.

(21) Appl. No.: 16/077,784

(22) PCT Filed: Jan. 20, 2017

(86) PCT No.: PCT/JP2017/001844
§ 371 (c)(1),
(2) Date: Aug. 14, 2018

(87) PCT Pub. No.: WO2017/141616
PCT Pub. Date: Aug. 24, 2017

(65) Prior Publication Data

US 2020/0030862 A1 Jan. 30, 2020

(30) Foreign Application Priority Data

Feb. 17, 2016 (JP) ..... JP2016-027855

(51) Int. Cl.
*B21B 1/22* (2006.01)
*B21B 15/00* (2006.01)

(52) U.S. Cl.
CPC ..... *B21B 1/22* (2013.01); *B21B 15/0085* (2013.01); *B21B 2015/0021* (2013.01)

(58) Field of Classification Search
CPC ..... B21B 1/22; B21B 15/0085; B21B 2015/0021; B21B 15/00; B21B 15/0007; B21B 2015/0092
See application file for complete search history.

(56) References Cited

U.S. PATENT DOCUMENTS 4,597,521 A 7/1986 Wilson
2006/0278615 A1 12/2006 Okawa

FOREIGN PATENT DOCUMENTS

CN 101357436 A 2/2009
JP H05-076911 A 3/1993
(Continued)

OTHER PUBLICATIONS

Mar. 7, 2017 International Search Report issued in International Patent Application No. PCT/JP2017/001844.
(Continued)

*Primary Examiner* — John C Hong
(74) *Attorney, Agent, or Firm* — Oliff PLC

(57) ABSTRACT

Notching equipment for a steel strip, a method of notching a steel strip, a cold rolling equipment, and a method of cold rolling that make it possible to perform cold rolling on a material without weld breaks, even if the material is a brittle material or a high alloy material such as a silicon steel sheet or a high-tensile steel sheet with high Si and Mn contents. The notching equipment includes a shearing device and a grinding device. The shearing device performs shearing on both edge portions in the steel-strip width direction including the joint to form a first notch. The grinding device grinds end surfaces of both the edge portions of the joint in the steel-strip width direction to form a second notch.

20 Claims, 6 Drawing Sheets

(56) References Cited

FOREIGN PATENT DOCUMENTS

| | | | |
|---|---|---|---|
| JP | H11-169942 | A | 6/1999 |
| JP | 2000-280093 | A | 10/2000 |
| JP | 2006-341276 | A | 12/2006 |
| JP | 2014-50853 | A | 3/2014 |
| SU | 1470371 | A1 | 4/1989 |
| SU | 1547886 | A1 | 3/1990 |

OTHER PUBLICATIONS

Jan. 22, 2019 Office Action issued in Taiwanese Patent Application No. 106104673.
Jan. 10, 2019 Office Action issued in European Patent Application No. 17752880.9.
Apr. 1, 2019 Office Action issued in Chinese Patent Application No. 201780011845.2.
Apr. 22, 2019 Office Action issued in Russian Patent Application No. 2018129926.
Mar. 19, 2020 Office Action issued in Korean Patent Application No. 10-2018-7023176.
Nov. 25, 2019 Office Action issued in Korean Patent Application No. 10-2018-7023176.
May 6, 2020 Office Action issued in Korean Application No. 10-2018-7023176.

RELATED ART (A) #120 GRINDSTONE (a)

(b)

(B) #36 GRINDSTONE (a)

(b)

NOTCHING EQUIPMENT FOR STEEL STRIP, METHOD OF NOTCHING STEEL STRIP, COLD ROLLING FACILITY, AND METHOD OF COLD ROLLING

TECHNICAL FIELD

The present disclosure relates to equipment for notching a joint of steel strips, a method of notching a joint of steel strips, a cold rolling facility, and a method of cold rolling.

BACKGROUND ART

Typically, in a cold rolling process for a steel strip, in order to improve productivity and yield, a preceding material (preceding steel strip) and a succeeding material (succeeding steel strip) are continuously supplied to a cold rolling line by joining a trailing end of the preceding material and a leading end of the succeeding material to each other. Thus, the steel strip can be rolled with tension applied to the entire length thereof. This makes the thickness and the shape possible to be highly accurately controlled even at the leading end and the trailing end of the steel strip.

Along with being higher alloy components in cold rolled steel strips and advancement of laser welding machines, laser welding is becoming mainstream instead of related-art flash butt welding and the like in joining the preceding material and the succeeding material to each other. However, regardless of whether the flash butt welding or the laser welding is used as welding means, widthwise step portions are unavoidably formed at end portions (edge portions) of a joint (weld) of the preceding material and the succeeding material in a sheet width direction due to the difference in steel strip width and a shift in widthwise position between the preceding material and the succeeding material. When rolling is performed in this state, stress may be concentrated on the widthwise steps to occasionally lead to breaks in the weld. Occurrence of the breaks in the weld (weld break) makes the cold rolling line stop, thereby, reducing productivity significantly and replacing a work roll which leads to an increase in production cost.

Particularly in recent years, a demand for reduction in thickness of cold rolled steel strips has been more increasing for the purposes of reducing the weight and improving the characteristics of members. Along with this tendency, presently, the reduction ratio required for cold rolling is increasing, and the weld brake rate is increasing.

In order to prevent the breaks in the weld, notching has been performed before rolling. The notching involves forming notches (cutouts) at end portions of the weld in the sheet width direction. This notching is also aimed at cutting portions of the steel strip having low strength (about 30 mm at sheet width ends in the steel width), because at the sheet width end portions of the steel strip, strength is likely to be reduced due to insufficient welding caused by poor butting accuracy.

As a method of notching, for example, mechanical shearing to form a semi-circular shape without a corner as disclosed in Patent Literature 1 is typical. However, the curvature of the outer edge of the semi-circular notches is uniform, and the width of the steel strip is smallest in the joint. Thus, maximum stress is generated in the joint.

In contrast, in order to eliminate the problem with Patent Literature 1, Patent Literature 2 discloses a method of notching. By this method, substantially isosceles trapezoidal notches are formed so as to cause maximum stress to be generated at positions other than the weld.

CITATION LIST

Patent Literature

PTL 1: Japanese Unexamined Patent Application Publication No. 5-076911

PTL 2: Japanese Unexamined Patent Application Publication No. 2014-50853

SUMMARY

Technical Problem

However, the above-described methods can not perform sufficient effects in case of notching particularly in cold rolling of brittle materials and high alloy materials such as silicon steel sheets and high-tensile steel sheets with high Si and Mn contents. Thus, presently, it is impossible to sufficiently prevent the breaks in the joint (weld breaks) in cold rolling.

The present disclosure has been made in view of the above-described situation. An object of the present disclosure is to provide notching equipment for a steel strip, a method of notching a steel strip, a cold rolling facility, and a method of cold rolling that which make it possible to perform cold rolling on a material without the breaks in the joint (weld breaks) even if the material would be a brittle material or a high alloy material such as a silicon steel sheet or a high-tensile steel sheet with high Si and Mn contents.

Solution to Problem

Although the details will be described later, as a result of earnest study to achieve the above-described object, the inventors found that when notching the weld by shearing as in the related-art, work hardening occurs at the end portions of the weld in the sheet width direction, and this causes the weld breaks. The inventors, in order to prevent the weld from breaking, conceived formation of notches substantially without forming work hardened portions at the end portions of the weld in the sheet width direction. In particular, this notching is formed by grinding or combination of shearing and grinding.

The present disclosure has been made in accordance with the above-described conception and includes the following exemplary disclosed embodiments.

[1] Notching equipment for a steel strip for forming notches at both edge portions of a joint in a steel-strip width direction, the joint at which a trailing end of a preceding steel strip and a leading end of a succeeding steel strip are joined to each other, the equipment including: a shearing device that performs shearing on both edge portions in the steel-strip width direction including the joint to form first notch; and a grinding device that grinds end surfaces of both the edge portions of the joint in the steel-strip width direction to form second notch.

[2] Notching equipment for a steel strip for forming notches at both edge portions of a joint in a steel-strip width direction, the joint at which a trailing end of a preceding steel strip and a leading end of a succeeding steel strip are joined to each other, the equipment for notching including: a grinding device that grinds end surfaces of both edge portions in the steel-strip width direction including the joint to form notches.

[3] A method of notching a steel strip for forming notches at both edge portions of a joint in a steel-strip width direction where a trailing end of a preceding steel strip and a leading end of a succeeding steel strip are joined to each other, the method including the steps of: performing shearing on both edge portions in the steel-strip width direction including the joint, to form first notch; and thereafter, grinding end surfaces of both the edge portions of the joint in the steel-strip width direction, to form second notch.

[4] A method of notching a steel strip for forming notches at both edge portions of a joint in a steel-strip width direction where a trailing end of a preceding steel strip and a leading end of a succeeding steel strip are joined to each other, the method including the step of: grinding end surfaces of both edge portions in the steel-strip width direction including the joint, to form notches.

[5] A cold rolling facility including: the equipment according to [1] or [2] described above.

[6] A method of cold rolling including the steps of: forming the notches the notching method according to [3] or [4] described above; and thereafter, performing cold rolling.

Advantageous Effects

According to the present disclosure, it is possible to perform cold rolling on a material without breaks in a joint (weld breaks), even if the material is a brittle material or a high alloy material such as a silicon steel sheet or a high-tensile steel sheet with high Si and Mn contents.

DESCRIPTION OF EMBODIMENTS

As has been described, the inventors found that a cause of breaks in a weld is work hardening at end portions of the weld in a sheet width direction occurring due to notching performed on the weld by shearing as in the related-art. The inventors, in order to prevent the weld from breaking, conceived a method of notching so as to form notches substantially without forming work hardened portions at the end portions of the weld in the sheet width direction. First, the finding and conception of the inventors will be described in detail.

That is, in order to find the causes of easy breaking of the weld, the inventors conducted a laboratory-scale rolling experiment as described below.

Figure 1:
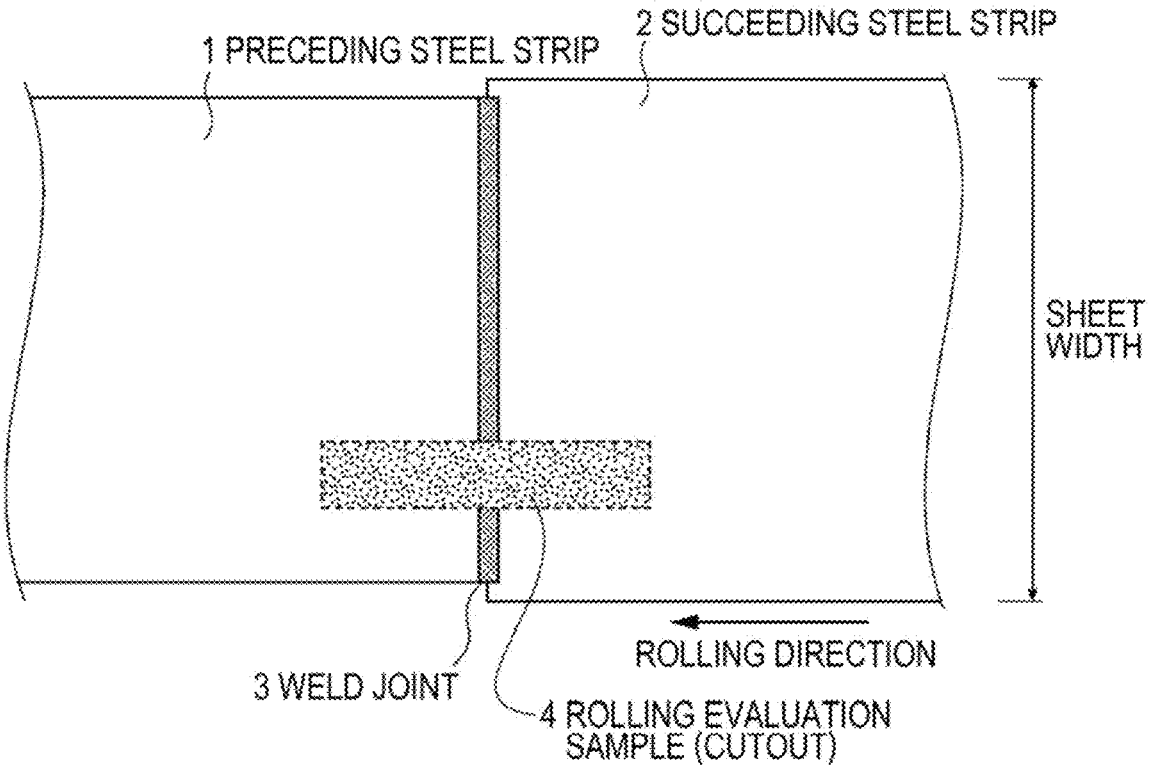
FIG. 1 illustrates a method of sampling a rolling evaluation test sample.

2 mm thick silicon steel sheets containing a content of Si of 3.3 mass % were used as a sample, and, as illustrated in FIG. 1, a trailing end of a preceding steel strip 1 and a leading end of a succeeding steel strip 2 were welded to each other by a laser welding machine. A rectangular sample (rolling evaluation sample) 4 having the long side in a direction perpendicular to a welding direction was cut out and extracted by shearing such that the sample 4 includes part of a weld 3.

The sample 4 fabricated as described above was cold rolled without applying tension. In this cold rolling, the total reduction ratio is 90% through three passes. A rolling mill used for this cold rolling has the work roll diameter of 500 mm.

Figure 2:
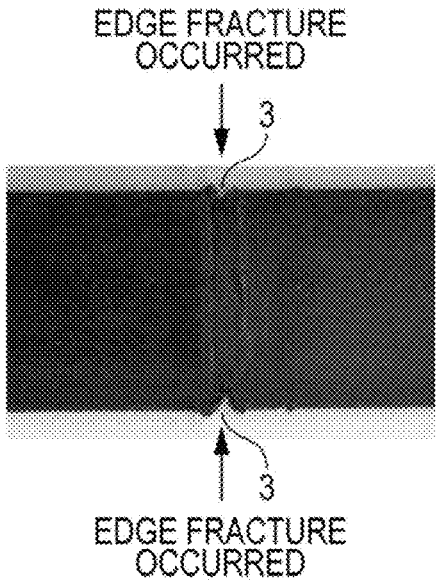
RELATED ART FIG. 2
FIG. 2 illustrates a state of edge fractures of a sheared material after cold rolling has been performed.

FIG. 2 is a photograph of the appearance of a steel sheet obtained after the cold rolling has been performed. Even in the case where no tension was applied, it can be seen that edge fractures occurred in the weld (weld metal region) 3. In a tandem rolling in which rolling is performed with tension applied as in an actual production, it is assumable that the breaks in the weld start from these edge fractures.

Figure 3:
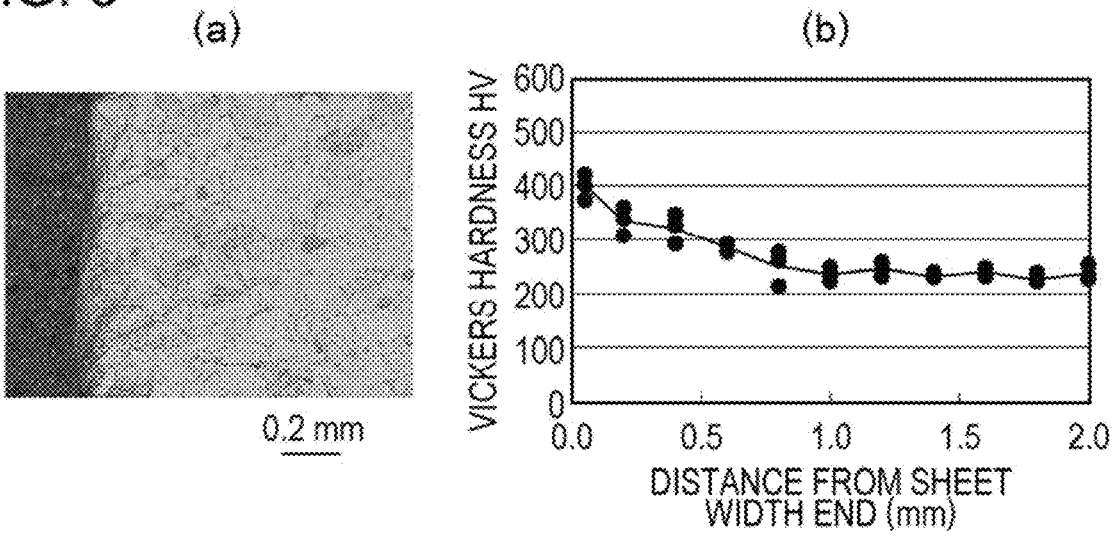
FIG. 3 illustrates a structure and a distribution of hardness of an edge section of the sheared material.

Then, end portions in the sheet width direction was cut along the sheet width direction in a step in which the shearing had been performed on the weld 3, that is, in a step before the cold rolling, thereby forming a cross section (edge cross section) to be observed. A structure of the section was observed and hardness testing was performed on this section. The result is illustrated in FIG. 3. View (a) of FIG. 3 illustrates the structure of the edge section, and view (b) of FIG. 3 illustrates a distribution of hardness of the edge section. As described above, the end portions of the weld in the sheet width direction were work hardened by the shearing. It was assumable that this work hardening is the cause of the edge fractures.

Accordingly, the inventors earnestly studied the method of notching for forming notches substantially without forming work hardened portions at the end portions of the weld in the sheet width direction and tried to grind the weld.

That is, the above-described rolling experiment involves shearing the weld of the rolling evaluation sample 4; performing a mechanical grinding on the weld by 1 mm in the sheet width direction to remove the cutout therefrom; and then performing cold rolling similar to that described above. The mechanical grinding was performed by using (A) and (B) below: (A) a disc grinder using a #120 grindstone made by 3M; and (B) a disc grinder using a #36 grindstone made by FUJI grinding wheel mfg. Co., Ltd.

Figure 4:
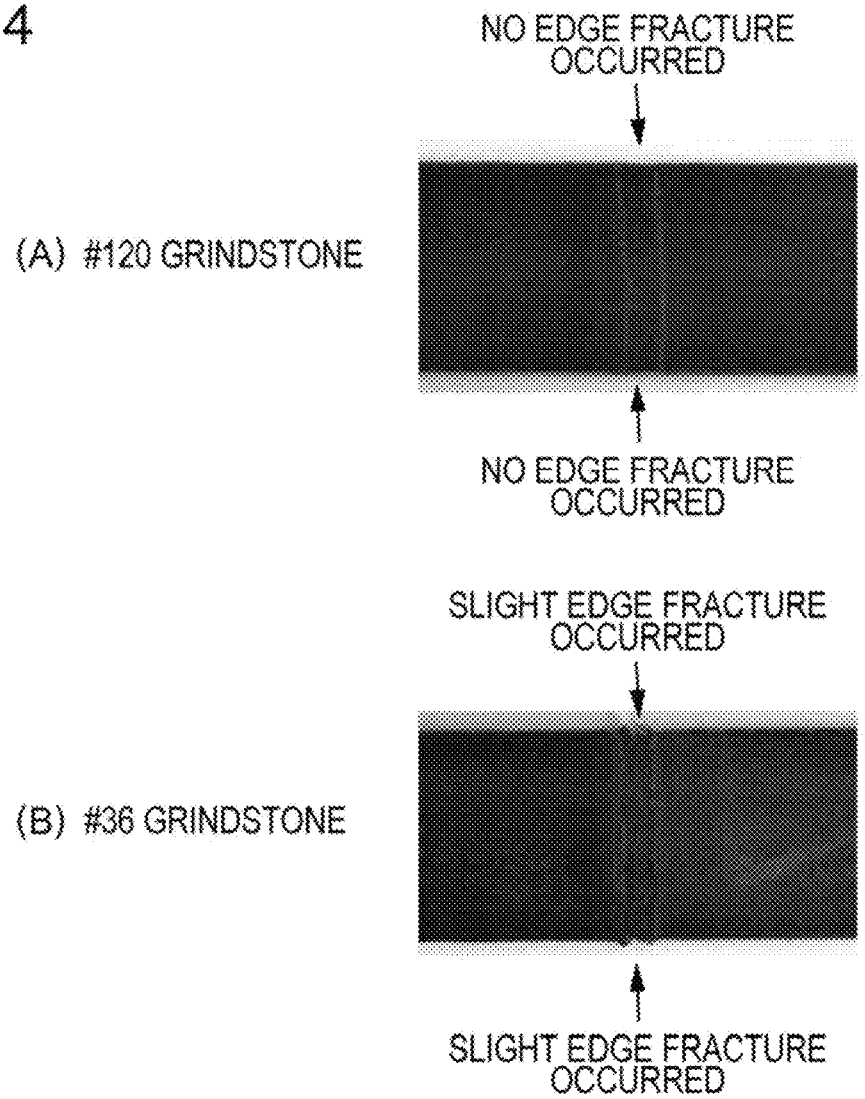
RELATED ART FIG. 4
FIG. 4 illustrates states of edge fractures of a material having ground edges observed after cold rolling has been performed.
Figure 5:
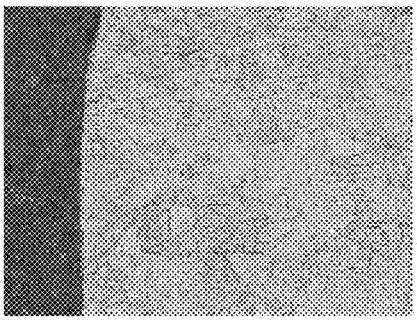
FIG. 5 illustrates structures and distributions of hardness of edge sections of materials having ground edges.
Figure 5:
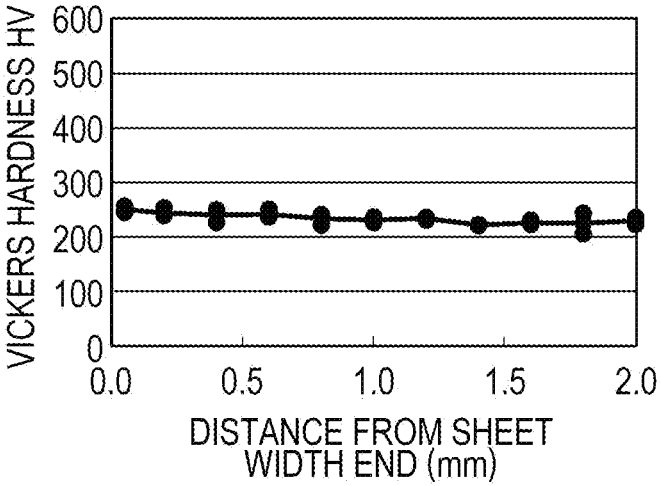
Figure 5:
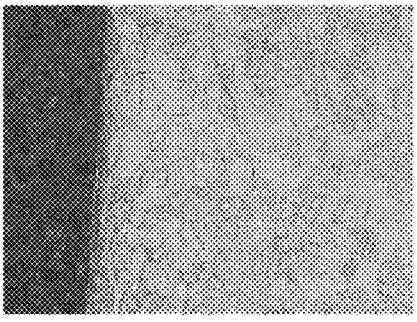
Figure 5:
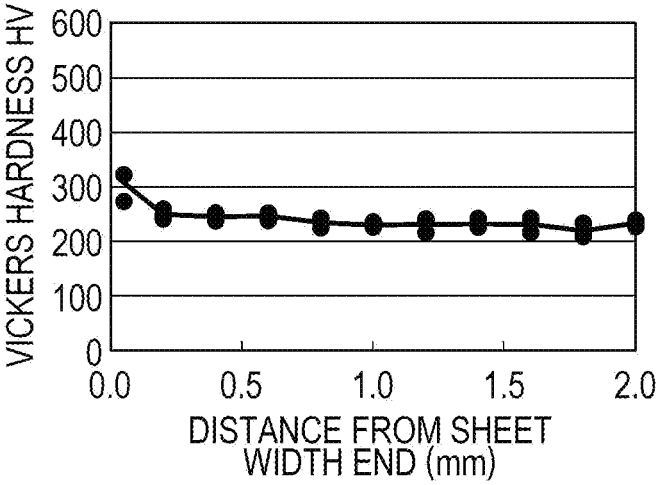

FIG. 4 illustrates the appearances of the steel sheets (corresponding to FIG. 2 above) obtained after the cold rolling. FIG. 5 illustrates the structural observation of edge sections and results of hardness testing performed on the edge sections (corresponding to FIG. 3 above). Grinding with (A) the #120 grindstone makes no edge fracture and no observation of work hardening in the edge portions. In contrast, grinding with (B) the #36 grindstone makes a slight edge fractures and observation of work hardening in the edge portions. However, the size of the edge fractures and the amount of work hardening were more significantly reduced than that in the case illustrated in FIGS. 2 and 3 where no process was performed after the shearing.

It has been found that, as has been described, the edge fractures in the weld are largely affected by work hardening of the weld occurring due to shearing, and removing the work hardened portions by grinding makes it possible to prevent the edge fractures.

Although grinding with (A) the #120 grindstone can eliminate the work hardening due to shearing, the grinding performance is low, and it took eight seconds to grind 1 mm in the above-described experiment. In contrast, grinding with (B) the #36 grindstone makes the grinding performance high, and it took no more than one second to grind 1 mm in the above-described experiment. In this case, however, some work hardening occurred in the edge portions.

Here, the work hardening refers to a state in which the Vickers hardness of the sheet width end portions is greater than the Vickers hardness of a base material portion (an inner portion separated from the sheet width end portions by 2 mm or more) by 50 HV or higher.

The following can be said from the above description. That is, it is important that there is no work hardened portion in the weld in the step where the notches have been formed in the weld, that is, before the cold rolling is performed.

Next, exemplary embodiments of the present disclosure will be described.

FIRST EMBODIMENT

Figure 6:
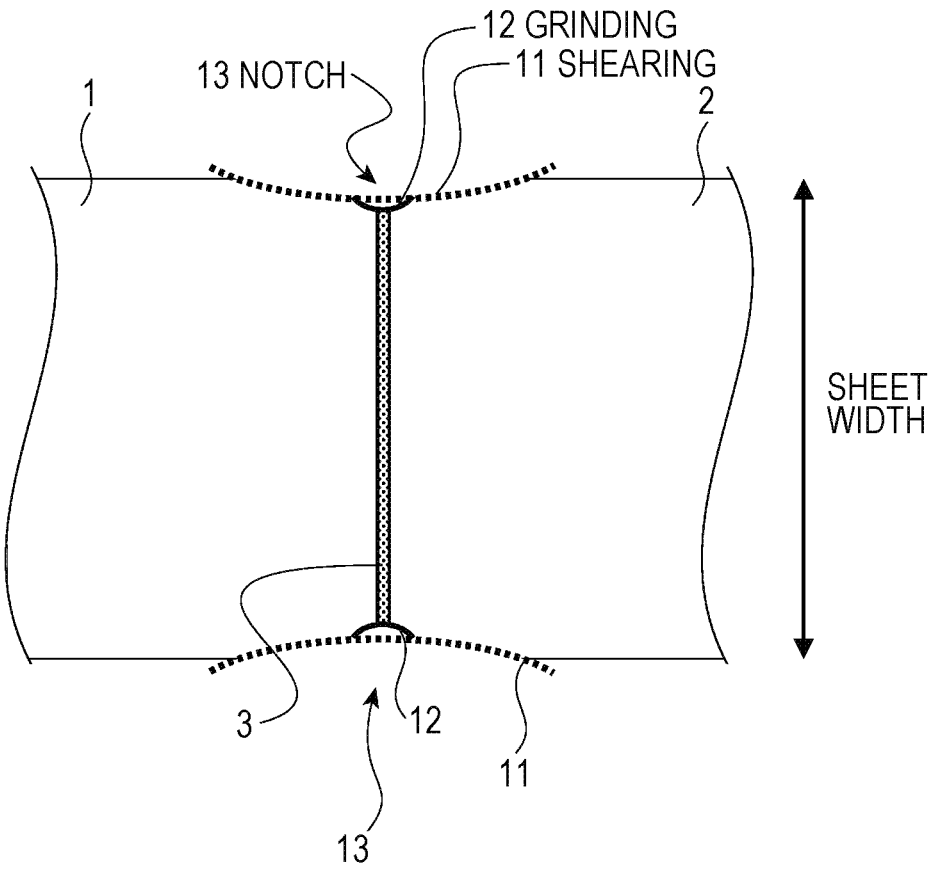
FIG. 6 illustrates notching according to a first embodiment.
Figure 9:
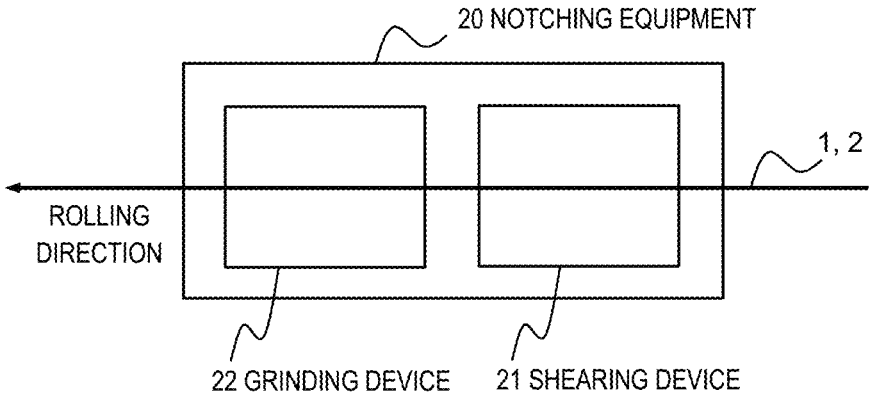
FIG. 9 illustrates a notching equipment according to the first embodiment.

FIGS. 6 and 9 illustrate a first embodiment of the present disclosure. As illustrated in FIG. 9, the first embodiment implements equipment for notching. The notching equipment 20 includes shearing device 21 (such as a shearing machine) which performs shearing on both edge portions in the steel-strip width direction and grinding device 22 (such as a disc grinder) which grinds end surfaces of both the edge portions in the steel-strip width direction. As illustrated in FIG. 6, the above-described equipment 20 performs first notching by shearing 11 specified regions including the end portions of the weld 3 for the preceding steel strip 1 and the succeeding steel strip 2 in the sheet width direction, thus to form arc-shaped notches. Thereafter, the equipment performs second notching by grinding 12 work hardened portions only in the weld 3 and regions near the weld 3, thus to remove the work hardened portions and finally to form notches 13. That is, in order to eliminate effects due to the difference in sheet width between the preceding steel strip 1 and the succeeding steel strip 2 and a shift in widthwise position between the preceding steel strip 1 and the succeeding steel strip 2, large notching (first notching: forming of the first notches) is performed before the shearing 11, and small notching (second notching: forming of the second notches) that removes only the work hardened portions in the weld is performed by grinding 12.

Thus, the first embodiment can form the notches 13 substantially without work hardened portions at the end portions of the weld 3 in the sheet width direction. Accordingly, it is possible to perform cold roll without the breaks in the weld even on a brittle material or a high alloy material such as a silicon steel sheet or a high-tensile steel sheet with high Si and Mn contents.

SECOND EMBODIMENT

Figure 7:
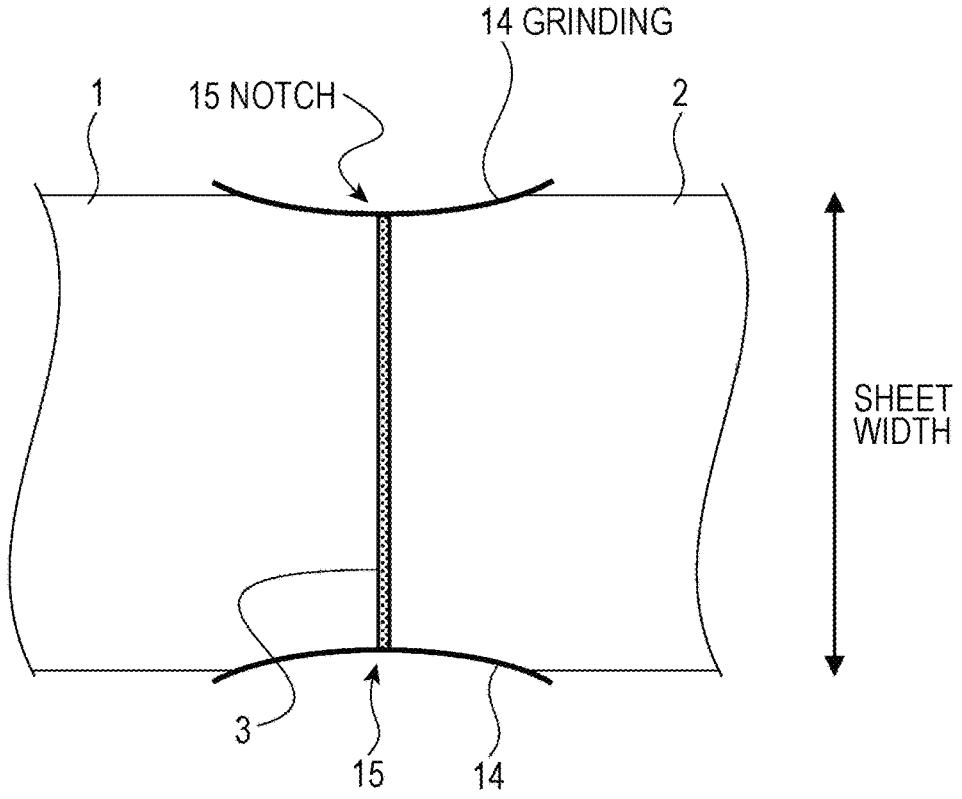
FIG. 7 illustrates notching according to a second embodiment.
Figure 10:
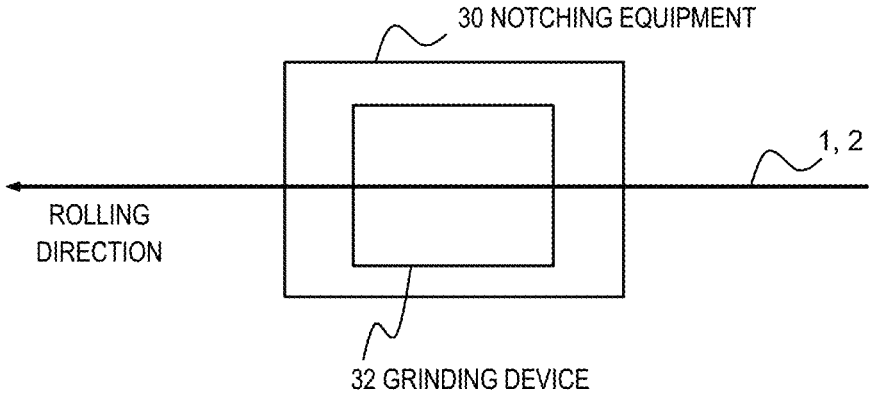
FIG. 10 illustrates a notching equipment according to the second embodiment.

FIGS. 7 and 10 illustrate a second embodiment of the present disclosure. As illustrated in FIG. 10, the second embodiment implements notching equipment 30 including a grinding device 32. The grinding device 32 (such as a disc grinder) grinds the end surfaces of both the edge portions in the steel-strip width direction. As illustrated in FIG. 7, arc-shaped notches 15 are formed by grinding 14 specified regions including the end portions of the weld 3 in the sheet width direction where the preceding steel strip 1 and the succeeding steel strip 2 are welded to each other. That is, according to the second embodiment, the entirety of the notches 15 are formed by the grinding 14.

Thus, the second embodiment can form the notches 15 substantially without forming work hardened portions at the end portions of the weld 3 in the sheet width direction. Accordingly, it is possible to perform cold roll without the breaks in the weld even on a brittle material or a high alloy material such as a silicon steel sheet or a high-tensile steel sheet with high Si and Mn contents.

The grain size of the grindstone is preferably #80 or finer in order to grind the edge portions without work hardening according to the above-described first and second embodiments, although it depends on the type of abrasive grain and pushing pressure.

Furthermore, an industrial robot or the like can grind the edge portions of the steel strip in a cold rolling line ground safely and in a short time. For example, grinding of the weld can be performed with a disc grinder installed in a robot such as MOTOMAN-MH50II ("MOTOMAN" is a registered trademark) made by YASUKAWA Electric Corporation.

Furthermore, whether to apply the above-described first embodiment or the above-described second embodiment may be appropriately determined from viewpoints of time, an installation space, the cost of the equipment, and so force allowed for formation of the notches.

It is required that the notches be formed in a short time in order to maintain the efficiency of a cold rolling process (the notching is preferably completed within about ten seconds, although the time depends on the length of the steel belt and the performance of loopers).

Furthermore, according to the present disclosure, the notches may have a semi-circular shape as described in Patent Literature 1 or a substantially isosceles trapezoidal shape as described in Patent Literature 2. Furthermore, there is no problem with notches having a shape other than the above-described shapes. According to the present disclosure, the shape of the notches is not particularly defined.

Furthermore, in the case of normal low carbon steel, the edge fractures do not occur even in shearing. However, with brittle materials and high alloy materials such as silicon steel sheets and high-tensile steel sheets with high Si and Mn contents, workability of the weld is poor. Thus, the edge fractures easily occur when these materials are work hardened due to shearing. That is, the present disclosure is not necessarily applied to the types of steel such as low carbon steel and the like in which the edge fractures do not occur and substantially no weld break occurs even in shearing. The present disclosure is to be applied to the type of steel such as a brittle material or a high alloy material in which a weld breaks by shearing. However, some cold tandem mills are dedicatedly used for silicon steel sheets or high-tensile steel sheets and other cold tandem mills are, instead of being dedicatedly used for silicon steel sheets or high-tensile steel sheets, used also to roll low carbon steel and so forth. In this case, the present disclosure is also applied to low carbon steel without a problem.

The silicon steel sheets with high Si and Mn contents refer to, for example, steel sheets containing Si: 1.0 to 6.5 mass % and Mn: 0.2 to 1.0 mass %. The high-tensile steel sheets with high Si and Mn contents refer to, for example, steel sheets containing Si: 1.0 to 2.0 mass % and Mn: 1.5 to 20.0 mass % and having a tensile strength of 590 to 1470 MPa.

First Example

As an example of the present disclosure, silicon steel sheets were produced by cold rolling equipment equipped with a five-stand cold tandem mill and evaluated.

In so doing, as a related-art example, performing shearing on specified regions including the weld formed semi-circular notching.

In contrast, a first present example performed notching according to the above-described first embodiment of the present disclosure. That is, the first notching was performed to form semi-circular notches by shearing on specified regions including the weld. Thereafter, as the second notching, the weld and regions near the weld were ground by 2 mm by a #80 grindstone.

Furthermore, a second present example performed notching according to the above-described second embodiment of the present disclosure. That is, semi-circular notches are formed by grinding specified regions including the weld by a #36 grindstone.

In each of the examples, 100 coils of steel strips that contain Si content of 3.1 mass % or more and less than 3.5 mass % and have a thickness of 1.8 or more and 2.4 mm or less were prepared and cold rolled by using the 5-stand cold tandem mill having been described above, so that the finished steel strips have a thickness of 0.3 or more and 0.5 mm or less. Weld break rates were mutually compared in the examples. The result is illustrated in FIG. 8.

Figure 8:
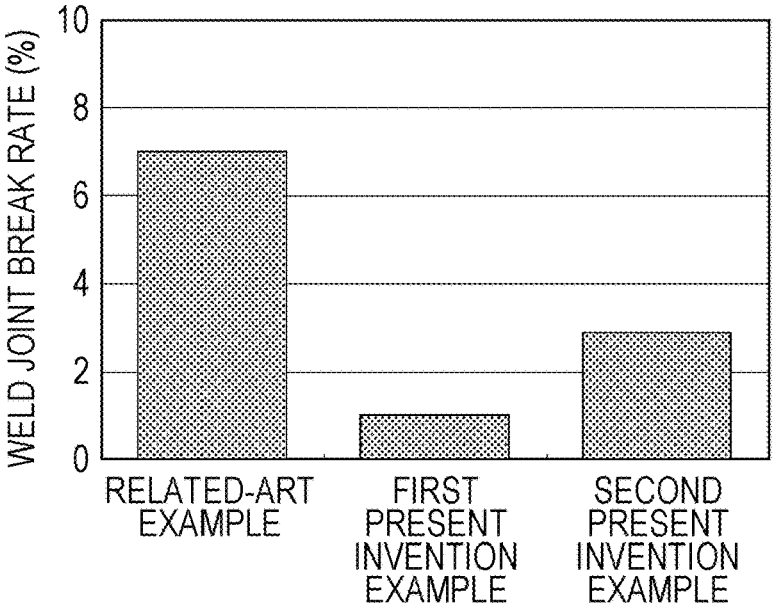
FIG. 8 compares weld break rates of examples of the present disclosure.

As illustrated in FIG. 8, the weld brake rate can be reduced to 1% with the first present example and 3% with the second present example whereas the weld brake rate is 7% with the related-art example.

Thus, the effectiveness of the present disclosure has been confirmed. That is, when the notching the weld between the preceding steel strip and the succeeding steel strip, the present disclosure is applied so as to form the notches substantially without forming work hardened portions at the end portions of the weld in the sheet width direction. Thus, the weld breaks due to cold rolling can be prevented, and accordingly, improvement in productivity and yield can be achieved.

REFERENCE SIGNS LIST

1 preceding steel strip
2 succeeding steel strip
3 weld
4 rolling evaluation sample
11 shearing
12 grinding
13 notch
14 grinding
15 notch

The invention claimed is:

1. Notching equipment for a steel strip for forming notches at both edge portions of a joint in a steel-strip width direction, the joint at which a trailing end of a preceding steel strip and a leading end of a succeeding steel strip are joined to each other, the equipment comprising:

a shearing device that is configured to perform shearing on both edge portions in the steel-strip width direction including the joint to form a first notch; and a grinding device that is configured to grind end surfaces of both the edge portions of the joint in the steel-strip width direction to form a second notch.

2. A cold rolling facility comprising:

the equipment according to claim 1.

3. The equipment according to claim 1, wherein the grinding device is configured to form the second notch entirely within the first notch.

4. The equipment according to claim 1, wherein the grinding device is configured to remove work-hardened portions of the steel strips.

5. The equipment according to claim 1, wherein the grinding device is configured to grind the end surfaces so that a difference between (i) the Vickers hardness of the end surfaces and (ii) the Vickers hardness of a base material portion of the steel strips is less than 50 HV, the base material portion being an inner portion of the steel strips separated from the end surfaces by 2 mm or more in the width direction.

6. Notching equipment for a steel strip for forming notches at both edge portions of a joint in a steel-strip width direction, the joint at which a trailing end of a preceding steel strip and a leading end of a succeeding steel strip are joined to each other, the equipment for notching comprising:

a grinding device that is configured to grind end surfaces of both edge portions in the steel-strip width direction including the joint to form notches.

7. A cold rolling facility comprising:

the equipment according to claim 6.

8. The equipment according to claim 6, wherein the grinding device is configured to grind the end surfaces so that a difference between (i) the Vickers hardness of the end surfaces and (ii) the Vickers hardness of a base material portion of the steel strips is less than 50 HV, the base material portion being an inner portion of the steel strips separated from the end surfaces by 2 mm or more in the width direction.

9. A method of notching a steel strip for forming notches at both edge portions of a joint in a steel-strip width direction where a trailing end of a preceding steel strip and a leading end of a succeeding steel strip are joined to each other, the method comprising the steps of:

performing shearing on both edge portions in the steel-strip width direction, including the joint, to form a first notch; and thereafter, grinding end surfaces of both the edge portions of the joint in the steel-strip width direction to form a second notch.

10. A method of cold rolling comprising the steps of:

forming notches according to claim 9; and thereafter, performing cold rolling.

11. The method according to claim 9, wherein the second notch is formed entirely within the first notch.

12. The method according to claim 9, wherein the grinding removes work-hardened portions of the steel strips.

13. The method according to claim 9, wherein the end surfaces are grinded so that a difference between (i) the Vickers hardness of the end surfaces and (ii) the Vickers hardness of a base material portion of the steel strips is less than 50 HV, the base material portion being an inner portion of the steel strips separated from the end surfaces by 2 mm or more in the width direction.

14. The method according to claim 9, wherein the steel strips each have a composition comprising Si in an amount in the range of from 1.0 mass % to 6.5 mass %.

15. The method according to claim 9, wherein the steel strips each have a composition comprising Mn in an amount in the range of from 1.5 mass % to 20.0 mass %.

16. A method of notching a steel strip for forming notches at both edge portions of a joint in a steel-strip width direction where a trailing end of a preceding steel strip and a leading end of a succeeding steel strip are joined to each other, the method comprising the step of:

grinding end surfaces of both edge portions in the steel-strip width direction, including the joint, to form notches.

17. A method of cold rolling comprising the steps of:

forming the notches according to claim 16; and thereafter, performing cold rolling.

18. The method according to claim 16, wherein the end surfaces are grinded so that a difference between (i) the Vickers hardness of the end surfaces and (ii) the Vickers hardness of a base material portion of the steel strips is less than 50 HV, the base material portion being an inner portion of the steel strips separated from the end surfaces by 2 mm or more in the width direction.

19. The method according to claim 16, wherein the steel strips each have a composition comprising Si in an amount in the range of from 1.0 mass % to 6.5 mass %.

20. The method according to claim 16, wherein the steel strips each have a composition comprising Mn in an amount in the range of from 1.5 mass % to 20.0 mass %.

* * * * *